United States Patent [19]

Winston

[11] Patent Number: 5,060,934

[45] Date of Patent: Oct. 29, 1991

[54] HAND EXERCISER

[76] Inventor: Edith Winston, 135 Hazelwood Dr., Jericho, N.Y. 11753

[21] Appl. No.: 665,272

[22] Filed: Mar. 6, 1991

[51] Int. Cl.[5] ..... A63B 21/00

[52] U.S. Cl. ..... 272/68; 272/117; 272/DIG. 4

[58] Field of Search ..... 272/68, 122, 135–142, 272/99, 117, DIG. 4

[56] References Cited

U.S. PATENT DOCUMENTS

| | | | |
|---|---|---|---|
| 1,026,215 | 5/1912 | Korth | 272/68 |
| 4,433,364 | 2/1984 | Noble | 272/68 |
| 4,538,806 | 9/1985 | Wilkerson | 272/122 |
| 4,632,384 | 12/1986 | Bright | 272/68 |
| 4,756,522 | 7/1988 | Sandoval | 272/68 |
| 4,775,148 | 10/1988 | McLaughlin | 272/119 X |
| 4,778,173 | 10/1988 | Joutras | 272/122 X |
| 4,801,137 | 1/1989 | Douglass | 272/122 X |
| 4,830,361 | 5/1989 | Hoffman | 272/68 |
| 4,909,506 | 3/1990 | Smith | 272/137 X |

*Primary Examiner*—Robert Bahr
*Assistant Examiner*—J. L. Doyle

[57] ABSTRACT

A hand exerciser with grip handles which in use are alternately squeezed and released against the urgency of a spring, in which the spring in use is replaceable with another spring of different resistance, to thereby correspondingly vary the resistance of the exercise routine.

2 Claims, 3 Drawing Sheets

FIG.1
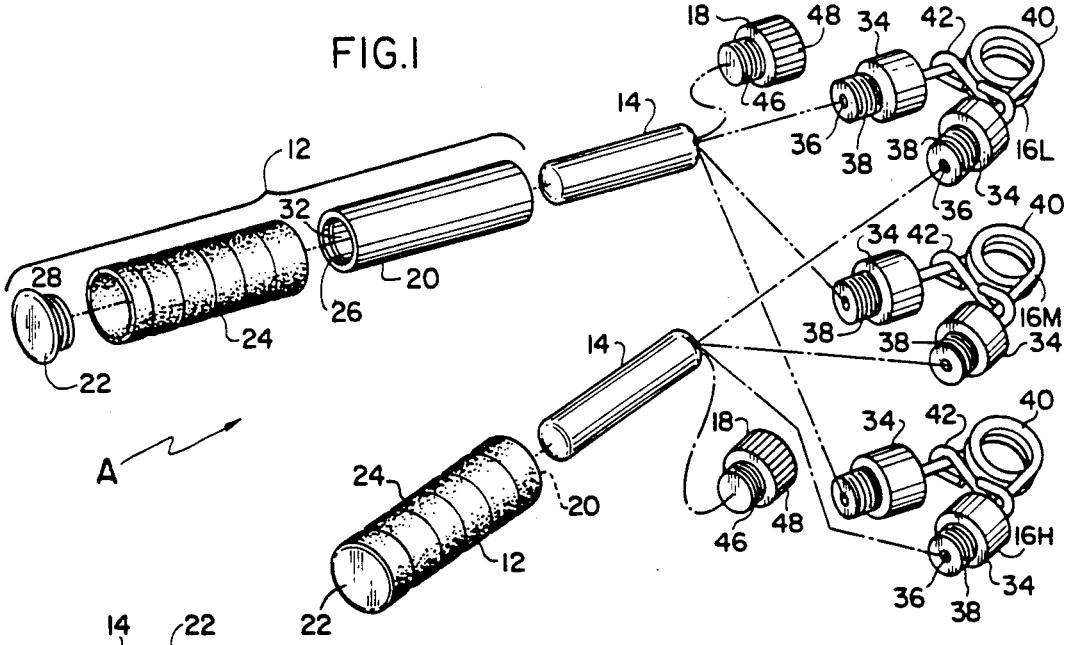
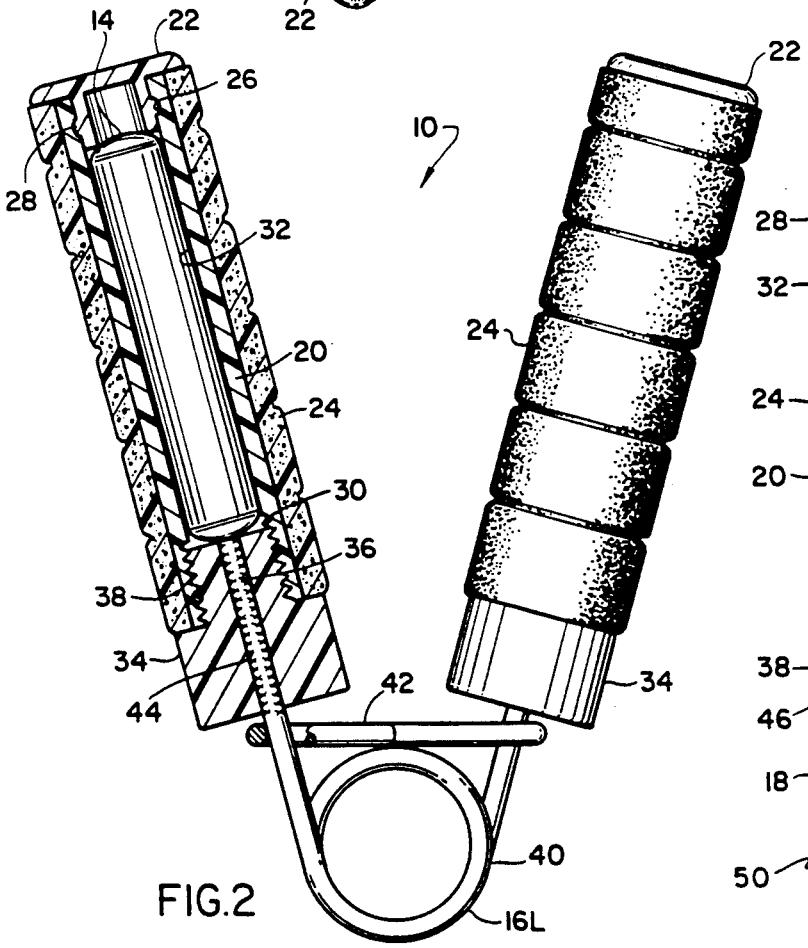
FIG.2
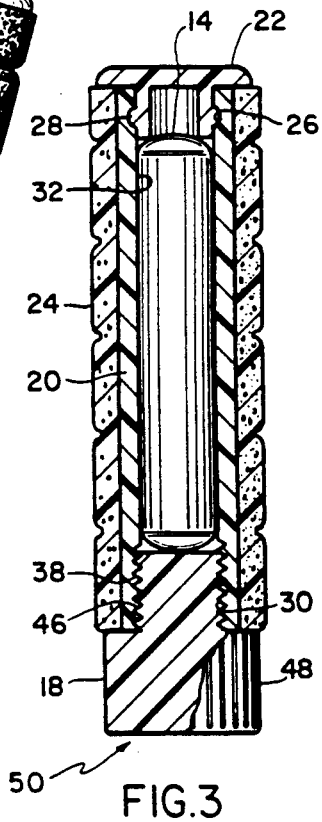
FIG.3

FIG.4
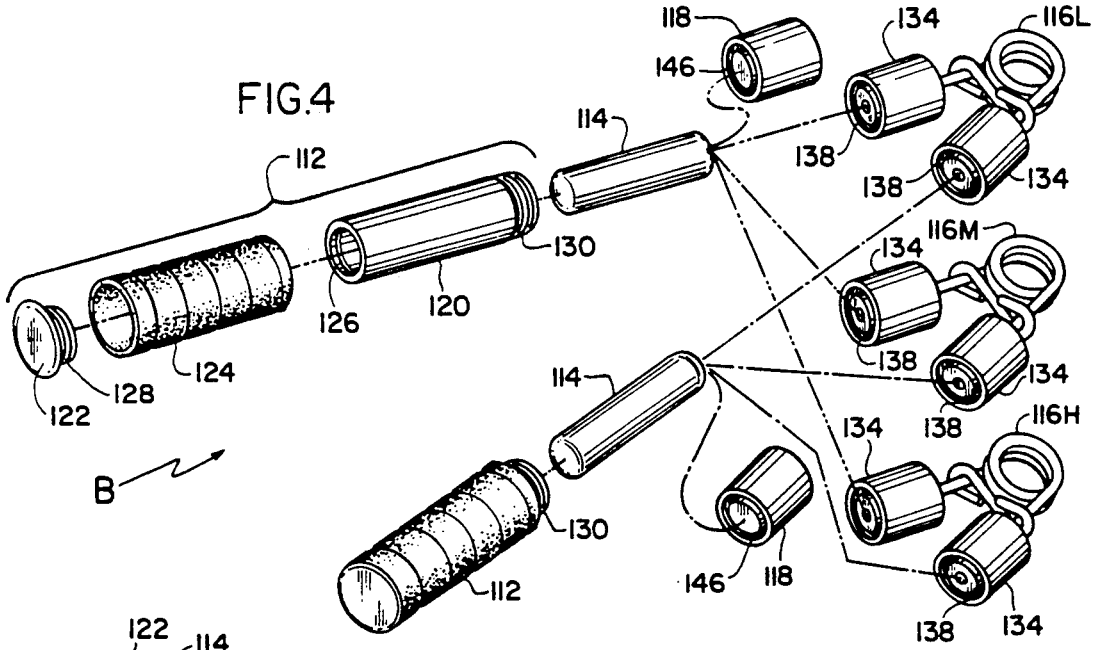
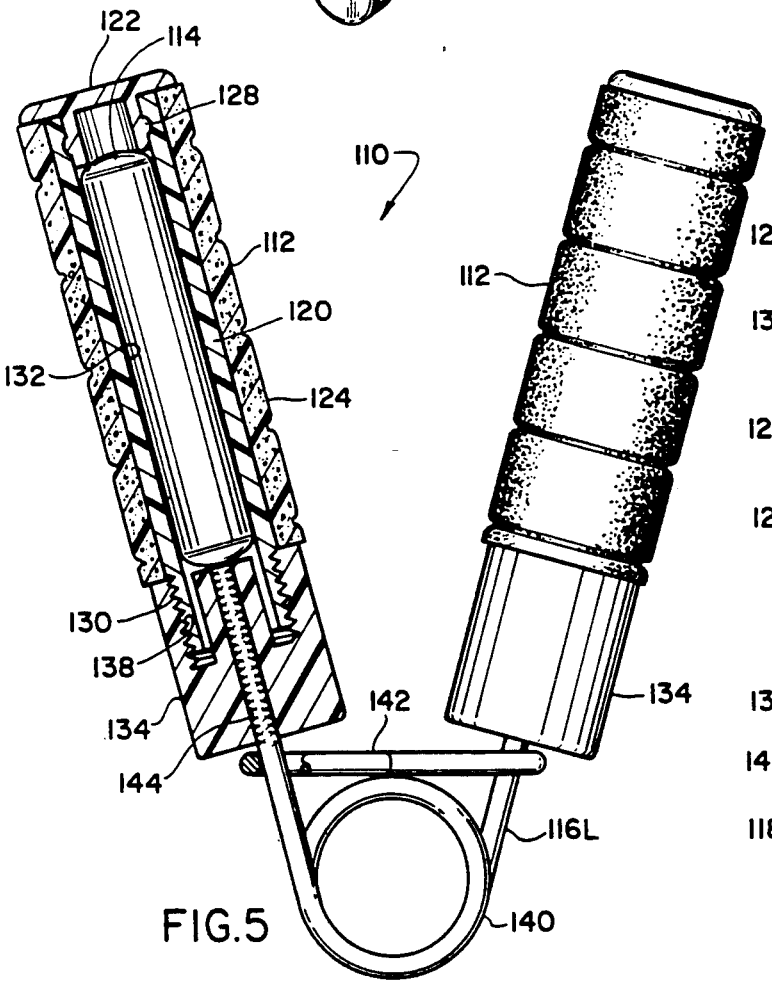
FIG.5
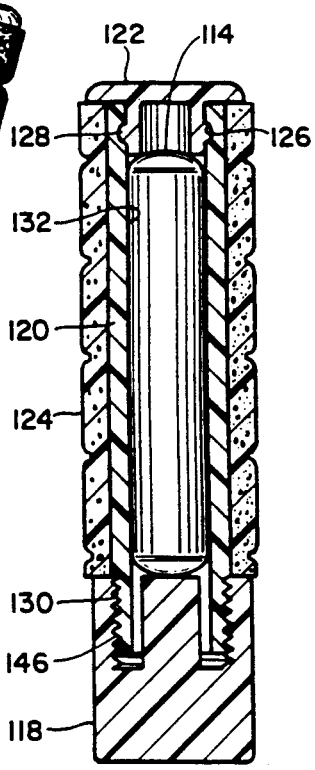
FIG.6

HAND EXERCISER

The present invention relates generally to hand exercisers in which the operating mode contemplates squeezing the handles thereof against a resistance spring, and more particularly to improvements for these resistance spring hand exercisers which allows, in a readily facilitated manner, the exerciser to vary the spring resistance of the exercise routine.

EXAMPLES OF THE PRIOR ART

Hand exercisers using a resistance spring are already well known, as exemplified by U.S. Pat. No. 965,284 issued to W. J. Dossetter on July 26, 1910 and U.S. Pat. No. 4,681,315 issued to TaiHer Yang on July 21, 1987. These patents exemplify the practice of supplying a single spring of a selected resistance for use during exercising, and thus correspondingly limiting the user only to the selected resistance of the spring.

In contrast, the within inventive hand exerciser uses more than one spring, although only one is used as a time, so that the exercise, in a preferred embodiment, can be performed using a spring of "light" resistance, or "medium" resistance, or "heavy" resistance. Also, the use of additional exercise weights are provided for, which add to the resistance of the springs, further increasing the exercising effort required of the user.

It is accordingly a general object of the present invention to provide an improved increased range of resistance in a hand exerciser, thereby overcoming the foregoing and other shortcomings of the prior art. More particularly, it is an object to embody the resistance spring then in use in the hand exerciser so that it is readily replaceable with another resistance spring, to thereby correspondingly change the exercising resistance. In part, the changeability in the springs is achieved using handles readily attached and unattached from the spring, preparatory to replacement of the spring. This is used to advantage by making the handles hollow, so that, when unattached, additional exercise weights can optionally be placed within the handles to further increase the resistance in the exercise routine.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is an exploded isometric view showing the components of a first embodiment of a hand exerciser which, according to the present invention is provided with interchangeable springs;

FIG. 2 is an elevational view of the FIG. 1 embodiment which is partly in cross section showing the components thereof in assembled relation;

FIG. 3 is a vertical cross sectional view of the handle component of the FIG. 1 embodiment;

FIG. 4 is an exploded isometric view, similar to FIG. 1, but showing the components of a second embodiment of the within inventive hand exerciser;

FIG. 5 is an elevational view of the FIG. 4 embodiment, which, similar to FIG. 2, is partly in cross section showing the components thereof in assembled relation;

FIG. 6 is a vertical cross sectional view of the FIG. 4 handle component;

Figure 7:
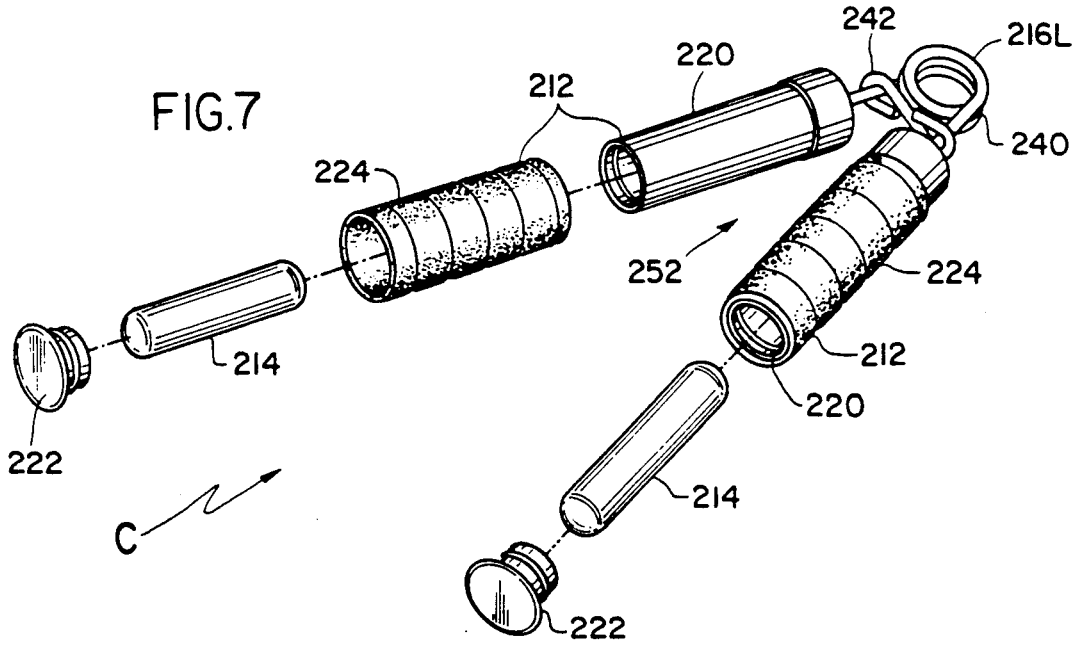
FIG. 7 is an exploded isometric view of a third embodiment of the within inventive hand exerciser.

In FIGS. 1, 2 and 3, a first variation or embodiment of the within inventive hand exerciser is shown, as it is contemplated being commercially supplied, namely in a kit A form, wherein the illustrated subassemblies and various components can be readily combined by the user into a hand exercise device 10. To this end, kit A consists of a pair of identically constructed handles 12, a pair of metal weights 14, a set for exercising purposes of three spring assemblies 16L, 16M and 16H, and a pair of threaded caps 18.

In FIG. 2, device 10 is shown in one possible assembled condition using the set of kit A components, preparatory to being used in a hand exercising routine, consisting of the squeezing together and releasing of the handles 12.

Each of identical handles 12 consists of a molded cylindrically shaped plastic barrel 20, a flanged plug 22 and a cylindrically shaped foam plastic outer sleeve 24 sized to fit about the barrel 20. One end of barrel 20 is made with an internal annular groove 26 which receives a cylindrical or annular ridge 28 on plug 22, while the opposite internal end of barrel 20 is provided with internal threads 30. The barrel throughbore 32 is sized to receive in a minimum sliding fit a cooperating exercising cylindrically shaped weight 14.

In addition to substituting different densities, and thus correspondingly different weight amounts, for the weights 14, to thereby vary the resistance against which the exerciser performs an exercising routine, the within inventive hand exerciser also contemplates varying this resistance by the selection of one of the springs 16L, 16M or 16H to be used in completing an assembled construction of the components of FIG. 1. Thus, if "light" resistance is preferred, the selection would be made of spring 16L, and "medium" resistance, the use of spring 16M, and "heavy" resistance, the use of spring 16H.

To implement the just noted concept of using a selected appropriate "light", "medium" or "heavy" exercising spring, it will be understood that each spring 16L, 16M and 16H is of the type consisting of a length of resilient wire of a selected resistance against the closing movement of the handles 12 to a "light", "medium" and "heavy" extent. In the form used, and as now will be described in detail, each wire length for the springs 16L, 16M and 16H is bent into a V-shape, with coils 40 at the apex of the V and two operative ends 36 for attachment to the handle assemblies 12.

More particularly, and taking as typical spring assembly 16L, the same consists of a torsion spring comprised of helical coils 40, and a limit link 42. Spring assembly 16L, as well as assemblies 16M and 16H, are each manufactured as follows. Ends 36 of the spring wire length are heavily knurled or swaged at 44 for eventual anchoring or attachment to closure members or hubs 34, after which torsion spring 40 is formed by the noted helical coils, and limit link 42 applied as shown to limit, in a well understood manner, opening movement of the spring ends or legs 36. A threaded plastic closure member or hub 34 is then molded about each end 36 of respective spring assemblies 16L, 16M and 16H. Each closure hub 34 has external threads 38 matching the pitch of the internal threads 30 of the handle barrels 20.

The spring assemblies 16 are optionally supplied in kit A with L, M and H designations that indicate progressive levels of torsion that are required to bring handles 12 towards each other when device 10 is in use.

FIG. 2 is exemplary of one assembled mode of the components in kit A preparatory to use as a hand exercise unit 10. Spring assemblies 16M and 16H, as well as cooperating hubs 34, 38, are, of course, set aside during use of spring 16L. The assembly 10 just described, can be used with or without weights 14, at the option of the user.

The device or hand exerciser 10 is used to develop hand and lower arm strength by repeatedly squeezing handles 12 against the force of spring 16L. When the required squeezing force is relaxed the urgency in spring 16L forces the handles 12 to their open or outward position, which is limited by limit link 42. Should the user desire to increase the level of exercising resistance of the exercising routine, spring 16L can readily be replaced with one of the other spring assemblies 16M or spring assembly 16H.

In an alternate mode of use the springs 16L, 16M and 16H can be dispensed with and handle 12 employed with internal weight(s) 14 confined therein by the separate plug(s) 18. To this end, each plug 18 has an external threaded portion adapted to threadably engage with the internal threads 30 of barrel 20. The plug outer surface 48 may be knurled for easy gripping. Assembled in the manner illustrated in FIG. 3, each handle 12 is transferred into a unit 50 that is readily used as a hand weight in connection with aerobic type exercises.

In a substantially similarly comprised and constructed second embodiment of device 10, as best shown in FIGS. 4, 5 and 6, like parts are designated by like numerals, but in a 100 numerical series. In this embodiment, all like parts are provided in a kit B, and functionally will be understood to be as previously described and used, except for the structural difference that allows for the interchange of internal and external threads that are used to connect handles 112 to closure members or hubs 134 on spring assemblies 116L, 116M and 116H. That is, the previously described internal threads 30 are in this embodiment provided as external threads 130 on barrel 120, and external threads 38 are provided as internal threads 138 on closure members or hubs 134, all as best shown in FIGS. 4 and 5.

Plug or cap 118 similarly has internal threads 146 to threadably engage external threads 130 on barrel 120, preparatory to use of one or both handles 112 in the noted aerobic exercising routine or mode as shown in FIG. 6.

Figure 8:
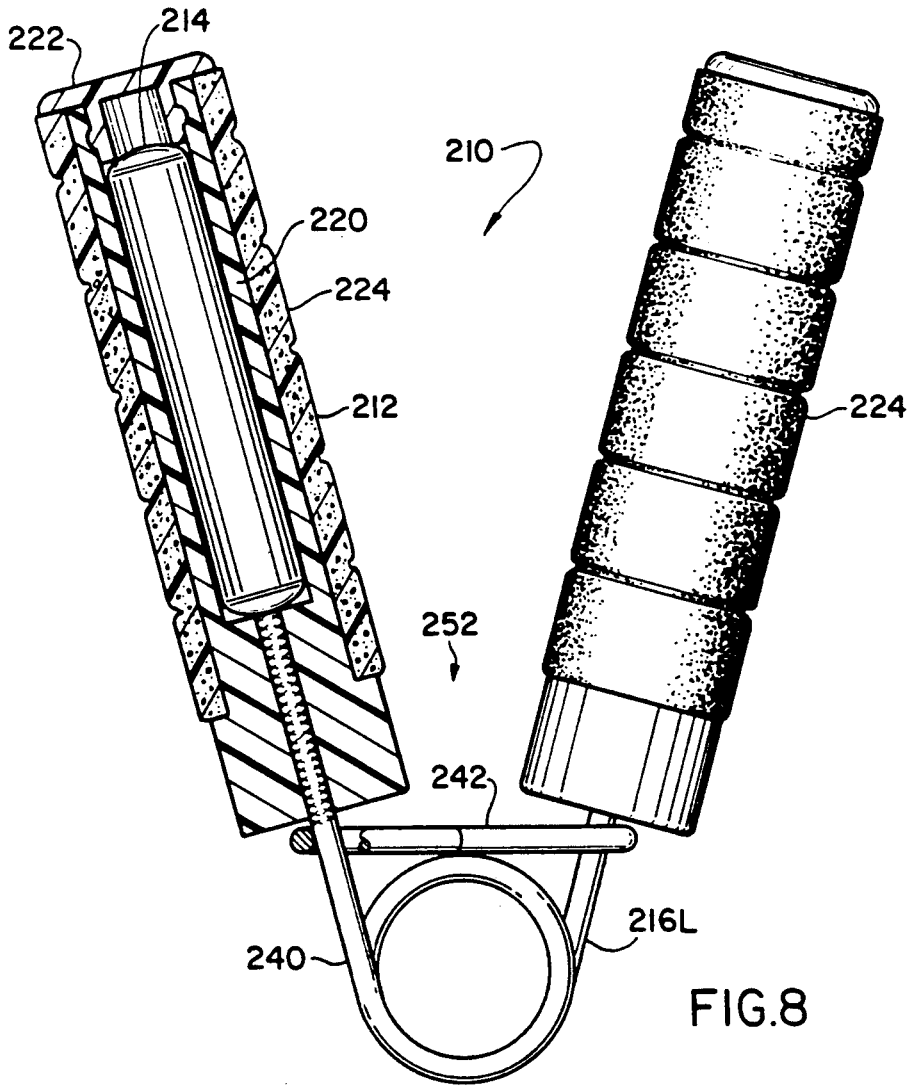
FIG. 8 is an elevational view of the FIG. 7 embodiment which is partly in cross section showing components thereof in assembled relation ready for use.

In a third embodiment of device 10 as best shown in FIGS. 7 and 8, again like parts are designated by like numerals, but in a 200 numerical series.

In the third embodiment, the kit C which is provided includes a barrel and spring assembly 252 as an integral unit, a pair of weights 214 and a pair of plugs 222, thus dispensing with hubs separate from the ends of the spring 240. Similar kits C may be supplied made up with a spring 16M (not shown) and a spring 16H (not shown). Thus, the two cooperating handles 212 are not detachable from spring assembly 216L. Rather, a pair of barrels 220 are molded integrally to spring assembly 216L. Foam sleeves 224 are subsequently applied to each barrel 220. Weights 214 are retained within handles 212 by plugs 222 as described in the earlier embodiments.

Each of the three embodiments assembled using the kits A, B and C are useable with none, only one, as well as with two weights 14, as desired by the exerciser.

While the embodiments of a hand exerciser herein shown and disclosed in detail is fully capable of attaining the objects and providing the advantages hereinbefore stated, it is to be understood that they are merely illustrative of presently preferred embodiments of the invention and that no limitations are intended to the detail of construction or design herein shown other than as defined in the appended claims.

What is claimed is:

1. A hand exerciser comprising a set of interchangeable exercising spring means including at least a first and second spring, each said spring comprising a length of resilient wire of a selected resistance bent into a V-shape and having two operative ends, a hub connected to each said operative end having exposed threads, and handles having cooperating threads for threadable attachment to said hubs.

2. A hand exerciser as claimed in claim 1 wherein said handles are hollow so as to bound storage compartments, and exercise weights are adapted to be inserted in said handle storage compartments preparatory to use of said hand exerciser.

* * * * *